US008297300B2

(12) United States Patent
Bejerano

(10) Patent No.: US 8,297,300 B2
(45) Date of Patent: Oct. 30, 2012

(54) ANTI-BACKFLOW VACUUM BREAKER VALVE

(76) Inventor: Abraham Bejerano, Phoenix, AZ (US)

( * ) Notice: Subject to any disclaimer, the term of this patent is extended or adjusted under 35 U.S.C. 154(b) by 250 days.

(21) Appl. No.: 12/803,934

(22) Filed: Jul. 9, 2010

(65) Prior Publication Data

US 2012/0006422 A1 Jan. 12, 2012

(51) Int. Cl.
*F16K 24/00* (2006.01)

(52) U.S. Cl. ..... 137/217; 137/513

(58) Field of Classification Search ..... 137/216, 137/216.1, 216.2, 217, 218, 15.06, 513
See application file for complete search history.

(56) References Cited

U.S. PATENT DOCUMENTS 651,289 A * 6/1900 Benton ..... 137/218
1,224,546 A * 5/1917 Hull ..... 137/513
3,929,149 A * 12/1975 Phillips ..... 137/216
4,064,896 A * 12/1977 Trenary ..... 137/218
4,524,794 A * 6/1985 Haines ..... 137/202
4,702,268 A * 10/1987 Ambruster et al. ..... 137/202
4,998,554 A * 3/1991 Rogers ..... 137/217
5,372,158 A * 12/1994 Berfield ..... 137/217
5,564,457 A * 10/1996 Beck ..... 137/15.06
5,709,247 A * 1/1998 Hutton ..... 137/884
2006/0278271 A1* 12/2006 Liu ..... 137/218
2008/0029161 A1* 2/2008 Montague ..... 137/217
2008/0047612 A1* 2/2008 Ball ..... 137/218

* cited by examiner

*Primary Examiner* — Eric Keasel
*Assistant Examiner* — Kevin Barss
(74) *Attorney, Agent, or Firm* — Roger C. Turner

(57) ABSTRACT

An anti-back flow vacuum breaker valve that includes a valve body having a cylindrical internal chamber having an upper portion and a reduced diameter lower portion forming a horizontal valve seat, and having an inlet communicating with the chamber on the underside of the valve seat, and having an outlet communicating with the chamber on the over side of the valve seat. A ball is positioned within the internal chamber for sealing the inlet of the valve body. A valve cap having a lower portion mating with the upper portion of the valve body sealed and securely attached to the valve body, and having an internal conical chamber having a central vertical journal therein, forming a journal vent with a vent seat at the lower end thereof aligned with the valve seat of the body. A buoyant vent plug having an upper stem slidably engaged within the journal vent of the cap, and the vent plug engagable with the vent seat, wherein the vent plug for elevation by the ball upon fluid flow through the inlet to seal the vent, and wherein the vent plug for elevation by backflow of fluid through the outlet to seal the vent.

10 Claims, 7 Drawing Sheets

ANTI-BACKFLOW VACUUM BREAKER VALVE

BACKGROUND OF THE INVENTION

The invention relates to a fluid control valve; particularly to an anti-backflow, anti-siphon vacuum breaker valve.

There are many fluid flow systems that supply fluid from a clean source for use in a potentially contaminated fluid environment. These systems are regulated by local laws to comply with certain industrial codes, standards and specifications to protect the clean source of fluid for other uses and users. These codes and laws generally require that none of the contaminated fluid is permitted to backflow into the clean (or potable) source of fluid. This requires a fluid control valve having a vacuum breaker vent to prevent any back-siphoning of the contaminated fluid, as well as a direct anti-backflow valve to prevent any backflow of the contaminated fluid from flowing into the clean source of fluid.

Some examples of such systems include agricultural water irrigation systems, home dialysis installations and other medical applications, solvent cleaning systems, industrial water and chemical applications, and numerous home and industrial plumbing and sewage handling applications.

There are many prior art devices, that have been developed for use in these applications and environments. Some examples of such devices include the Watts 188A for irrigation systems, the Watts 288A for hot or cold water anti-siphon vacuum breakers, and the Watts N338 for hot and cold water anti-siphon vacuum breaker having bottom inlet and outlet connections. There are numerous other manufacturers and suppliers of such devices.

The prior art devices, because of the venting design, usually require that the device be installed as the last component before the discharge end, and with no downstream shutoff valve, and not less than 12 inches above the discharge outlet. These requirements present design limitations for many fluid control systems.

A common problem associated with the prior art devices is that in certain backflow conditions, even though they comply with the anti-backflow requirements to protect the clean source, they permit the contaminated backflow fluid to flow through the vent into the open environment. This may not present a problem in outside irrigation applications or in industrial controlled spillage environments; but this is a major problem in many laboratory and home installations.

As shown in FIG. 1 (Prior Art), a typical example of a prior art device includes an anti-siphon vacuum breaker valve 10, having an inlet 12, an outlet 14, and an atmospheric vent 16. The valve includes an internal chamber having an inlet valve seat 18 and an upper vent seat 20, and a dual action disc valve 22. The valve is slidable on a vertical guide stem 24 and has a lower valve seal 26 and an upper vent seal 28.

In operations, the lower valve seat 18 is normally closed, and the upper vent seat 20 is normally open; when water pressure is supplied to the inlet (not shown), the disc valve 22 is elevated on the stem to open the water inlet valve seat 18 and the upper seal 28 engages the vent seat 20 to close the vent 16. When the water pressure at the inlet is discontinued, the disc valve 22 returns to the lower position. Also in operation, when backflow is applied through the outlet 14, the valve seal 26 engages the valve seat 18 and prevents contaminated flow from entering the inlet source fluid, but the vent seat 20 can not be sealed; and the contaminated fluid is permitted to flow through the vent 16 into the environment and onto the floor of the home or laboratory. This is a major mess, and potential health threat to the home or laboratory.

In view of the foregoing, it is an object of the present invention to provide an anti-siphon, anti-backflow, vacuum breaker valve that prevents any backflow of contaminated fluid into a clean (potable) fluid source, and prevents any backflow of contaminated fluid through the vent and into the environment and onto the floor of the home, laboratory or commercial facility.

It is another object to provide an anti-siphon anti-backflow vacuum breaker valve that is compact, economical to produce, and reliable and durable in operation.

It is another object to provide an anti-siphon anti-backflow vacuum breaker valve that can be installed in any sequence, including forward of a shut-off valve, and at any elevation, relative to the discharge end, in a fluid flow system.

SUMMARY OF THE INVENTION

The foregoing objects are accomplished by an improved anti-back flow vacuum breaker valve of the present invention. The valve includes a valve body having a generally (vertically oriented) cylindrical internal chamber having a threaded upper end and having a reduced diameter lower portion forming a horizontal valve seat. The valve seat preferably includes an elastomeric ring to provide a smooth resilient sealing surface. The body has an inlet communicating with the chamber on the underside of the valve seat, and has an outlet communicating with the chamber on the over side of the valve seat.

The valve includes a spherical ball positioned within the internal chamber having a diameter larger than the diameter of the valve seat for resting on the valve seat and sealing the inlet of the valve. The ball can be formed from a variety of metallic and plastic materials and requires a specific gravity great than that of the working fluid of the valve (greater than 1 for a water flow system).

The valve includes a cylindrical valve cap having an upper portion mating with the upper end of the valve body and having a reduced diameter lower portion with external threads for engaging the threaded upper end of the internal chamber of the valve body. The cap is securely screwed into the body and preferably includes an elastomeric compound or o-ring at the upper end for a positive seal. The cap has an internal upper conical chamber aligned vertically with the valve seat of the valve body and has a central vertical journal therein, forming a vent having a vent seat at the lower (internal) end thereof.

The valve further includes a buoyant vent plug having an upper stem slidably engaged within the journal vent of the cap to create a sealable vent passage. The upper surface of the vent plug is semi-spherical and is engagable with the vent seat to seal the vent. The vent plug is formed of a poly material having a specific gravity less than the working fluid in the system (less than 1 in a water flow system) to assure its buoyancy. Upon fluid pressure at the inlet, the ball is elevated to open the valve seat and elevates the vent plug against the vent seat to seal the vent. Upon any backflow through the outlet, the ball is forced downward to seal the inlet, and the backflow elevates the buoyant vent plug against the vent seat to seal the vent.

The valve thus has a fluid seal and a separate and independent vent seal to greatly improve the function and applications of the valve.

BRIEF DESCRIPTION OF THE DRAWINGS

While the novel features of the invention are set forth in the appended claims, the invention will be better understood along with other features thereof from the following detailed description taken in conjunction with the drawings, in which:

DETAILED DESCRIPTION OF THE INVENTION

Figure 1:
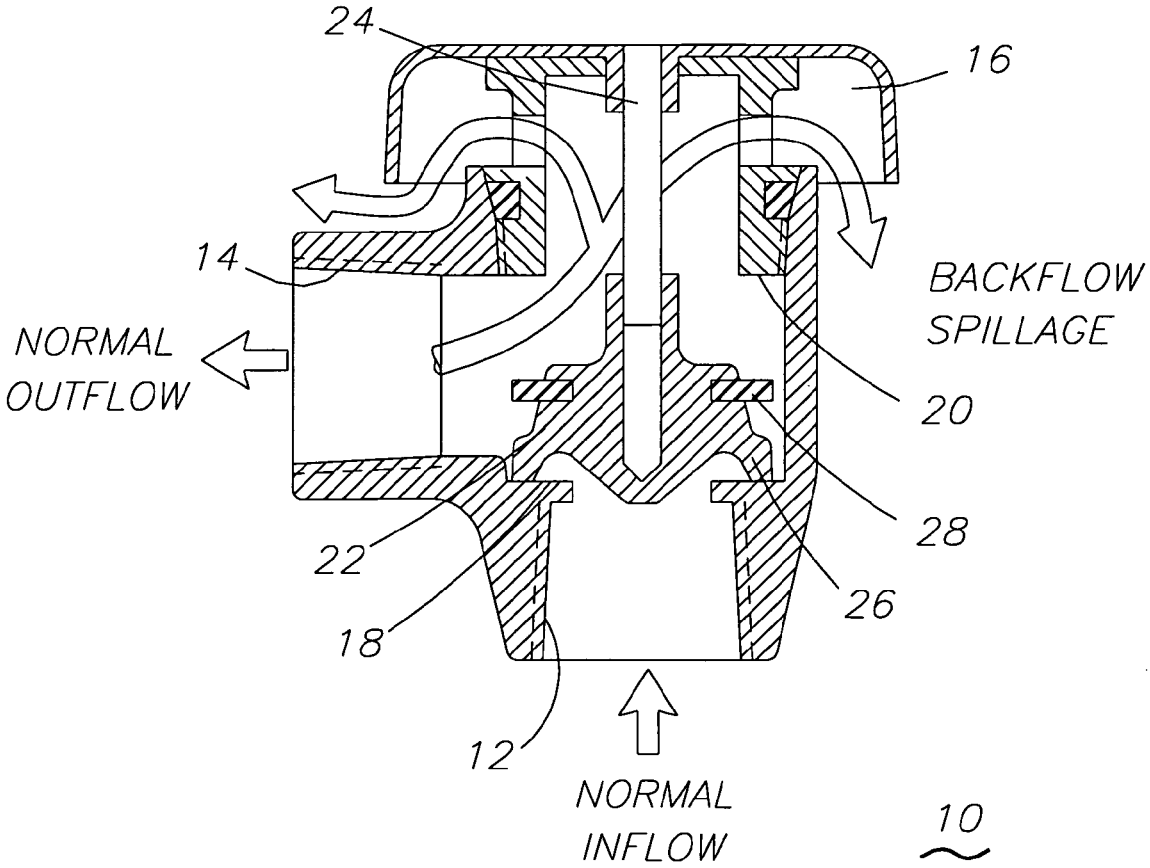
FIG. 1 (PRIOR ART)
FIG. 1 is a sectional view of a valve of the prior art.
Figure 2:
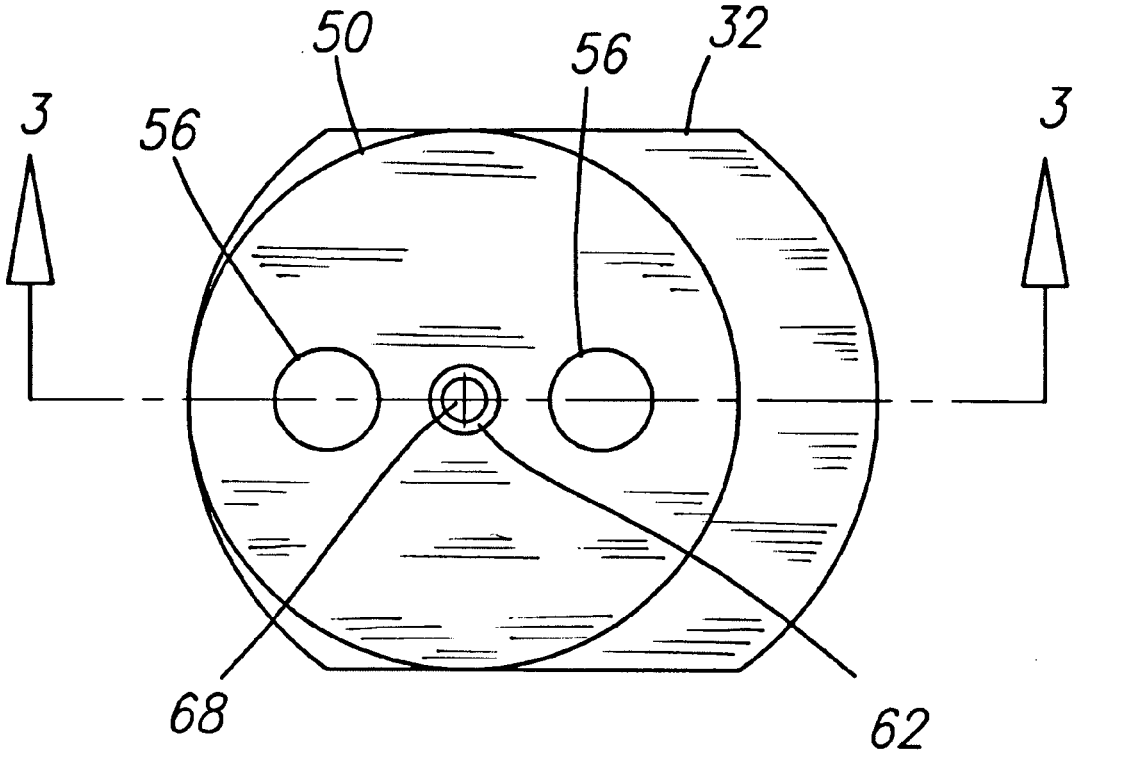
FIG. 2 is a top plan view of the valve of the present invention.
Figure 3:
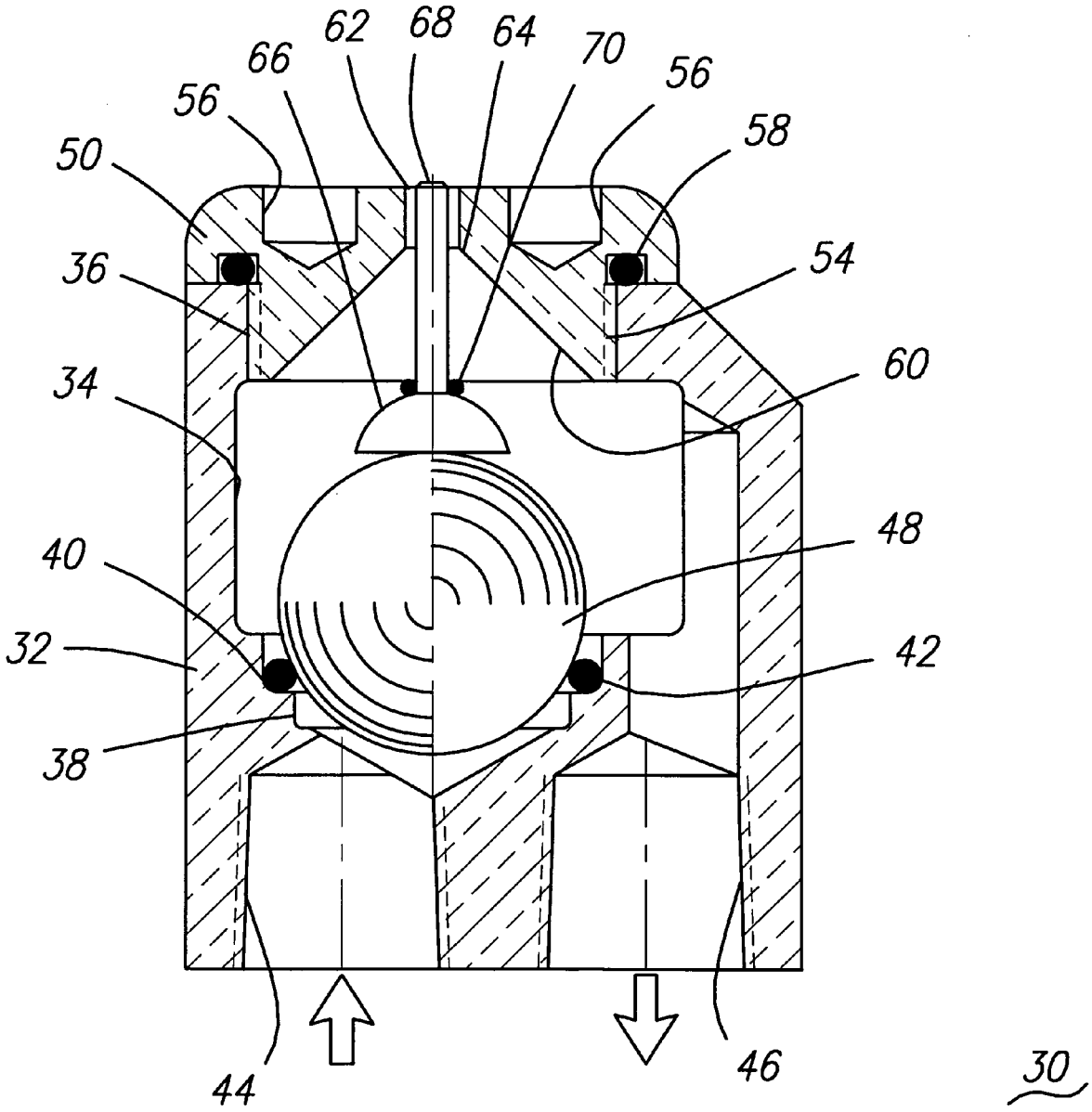
FIG. 3 is a sectional view taken along 3-3 of FIG. 2.
Figure 4:
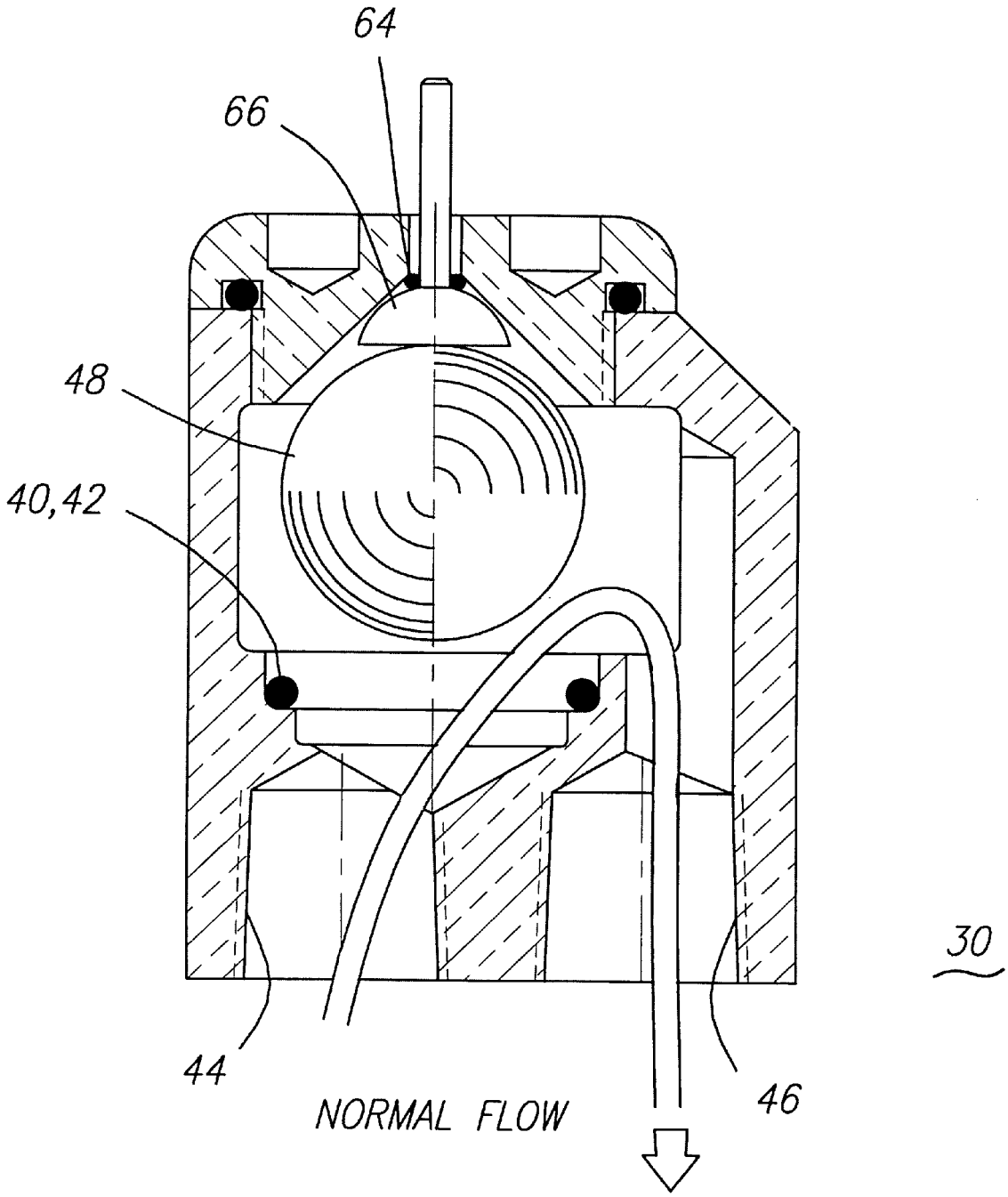
FIG. 4 is a view similar to FIG. 3, showing flow through the valve.
Figure 5:
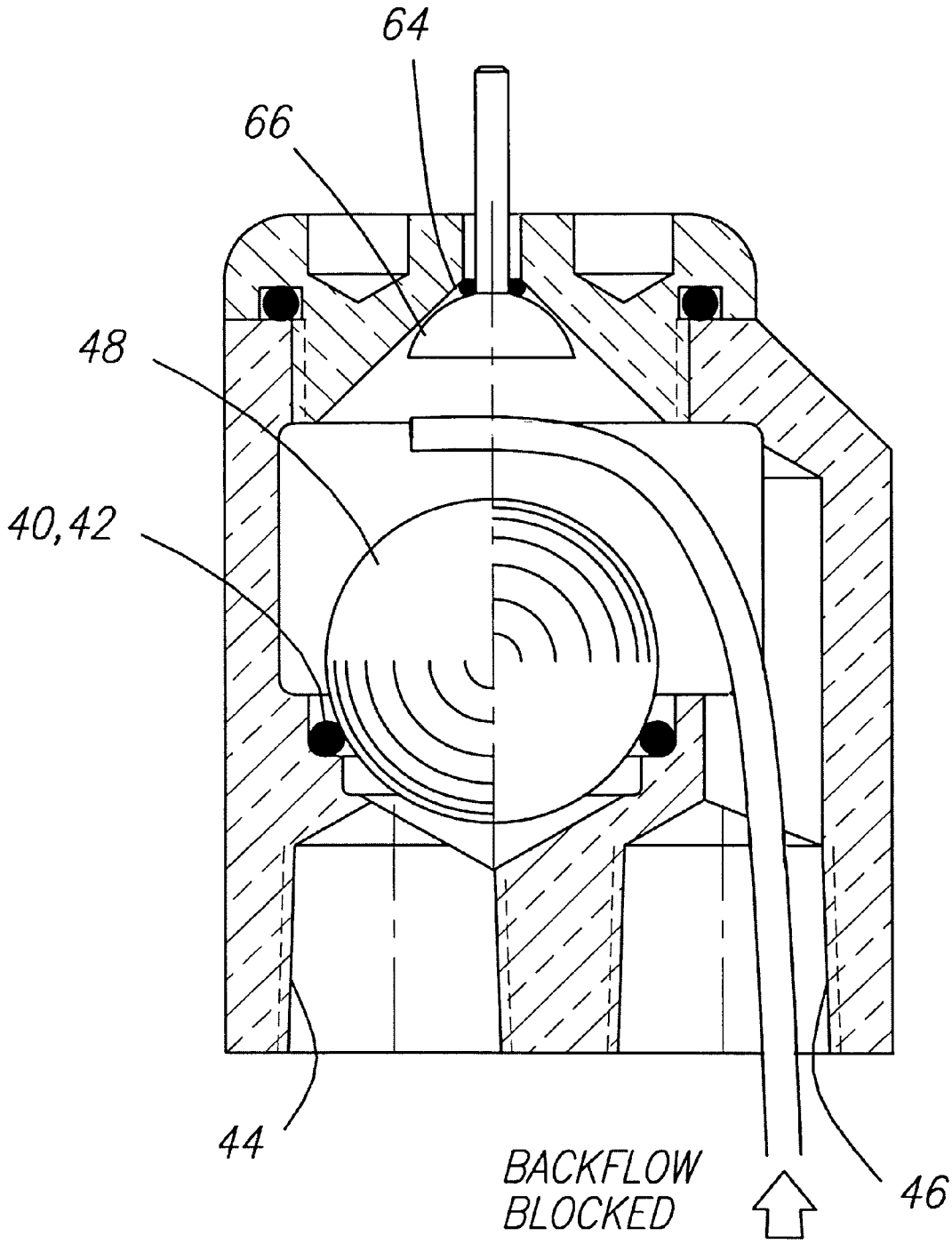
FIG. 5 is a view similar to FIG. 3, showing back flow pressure on the valve.

Referring first to FIG. 2, there is illustrated an example of a valve 30 of the present invention. Referring also to FIGS. 3-5, the valve includes a valve body 32 having a generally (vertically oriented) cylindrical internal chamber 34 having a threaded upper end 36 and having a reduced diameter lower portion 38 forming a horizontal valve seat 40. The valve seat preferably includes an elastomeric ring 42 to provide a smooth resilient sealing surface. The body has an inlet 44 communicating with the chamber on the underside of the valve seat, and has an outlet 46 communicating with the chamber on the over side of the valve seat. The inlet and outlet are typically threaded to receive standard plumbing connections (from about ⅛ inch to about 1 inch in diameters), but can be adapted for solder or other bonded connections. The valve body can be machined from a block of material, or injection molded from a variety of metallic, ceramic, or plastic materials, and is preferably formed of brass or stainless steel.

The valve includes a spherical ball 48 positioned within the internal chamber 34 having a diameter larger than the diameter of the valve seat 40, 42 for resting on the valve seat and sealing the inlet of the valve. The ball can be formed from a variety of metallic, ceramic and plastic materials and only requires a specific gravity great than that of the working fluid of the valve (greater than 1 for a water flow system). The ball is preferably formed of brass or stainless steel material for anti-corrosion properties and the weight assures a positive seal with the valve seat.

The valve includes a cylindrical valve cap 50 having an upper portion 52 mating with the upper end of the valve body 32 and having a reduced diameter lower portion 54 with external threads for engaging the threaded upper end 36 of the internal chamber of the valve body. The upper end of the cap includes a pair of recesses 56 for engagement with studs of a suitable wrench for rotation of the cap for assembly and disassembly. The cap is securely screwed into the body and preferably includes an elastomeric compound or O-ring 58 at the upper end thereof for a positive seal.

The upper end of the body and lower end of the cap could alternatively be connected by soldering or other bonding method, but the threaded engagement is preferable for ease of removal of the cap for cleaning or repair of the valve.

The cap has an internal upper conical chamber 60 aligned vertically with the valve seat 40 of the valve body. The cap further has a central vertical journal vent 62 with a vent seat 64 at the lower (internal) end thereof. The valve cap is preferably formed of the same material as the valve body.

The cap further includes a buoyant vent plug 66 having an upper stem 68 slidably engaged within the journal vent 62 of the conical chamber 60 of the cap to create a sealable vent passage. The upper surface of the vent plug is preferably semi-spherical and is engagable with the vent seat 64 to seal the journal vent. The vent plug can also be of frusta-conical shape having an angle similar to (or slightly more acute than) that of the conical chamber of the cap. The base of the stem preferably includes an elastomeric O-ring 70 to provide a smooth resilient seal with the vent seat. The vent plug is formed of a poly material having a specific gravity less than the working fluid in the system (less than 1 in a water flow system) to assure its buoyancy.

The vent passage is created between the relative dimensions of the journal vent 62 and the stem 68 of the vent plug 66 and is a significant feature of the present invention. This vent passage feature results from the relative clearance between the journal vent and the stem of the vent plug. A typical example of these relative dimensions includes the journal vent having a diameter of about 5/64(0.078) inch, and the stem of the plug having a diameter of about 1/16(0.062) inch. The vent feature of the valve may optionally be enhanced by including three or four evenly-spaced longitudinal ribs along the length of the stem of the vent plug. (Or alternatively by including several evenly spaced longitudinal flutes within the journal vent or the stem.) Naturally, the vent plug is pre-assembled within the valve cap prior to assembly of the cap to the valve body.

As shown in FIG. 4, upon fluid pressure at the inlet 44, the ball 48 is elevated by the inlet pressure to open the valve seat 40, 42, and the upper surface of the ball elevates the vent plug 66 against the vent seat 64 to seal the vent. The fluid flows readily through the outlet 46.

As shown in FIG. 5, upon any backflow pressure through the outlet 46, the ball 48 is forced downward to seal the valve seat 40, 42, and the backflow pressure elevates the buoyant vent plug 66 against the vent seat 64 to seal the journal vent. The valve does not permit any contaminated backflow to enter the inlet (clean fluid source) and the vent plug does not permit any contaminated backflow fluid to escape through the vent to create a mess or health hazard in the area of the valve.

The valve cap may further include a stand-off cover (not shown) to protect the valve stem when it is in the extended position. However it is preferably left uncovered to provide a visual and tactile indication of inflow pressure or backpressure acting on the valve of the fluid system.

The valve can be produced in many sizes (i.e. ⅛ inch to 1 inch diameter inlet/outlet) and several configurations. As shown in FIG. 3, the valve 30 can be arranged with a lower vertical inlet 44 and a lower vertical outlet 46.

Figure 6:
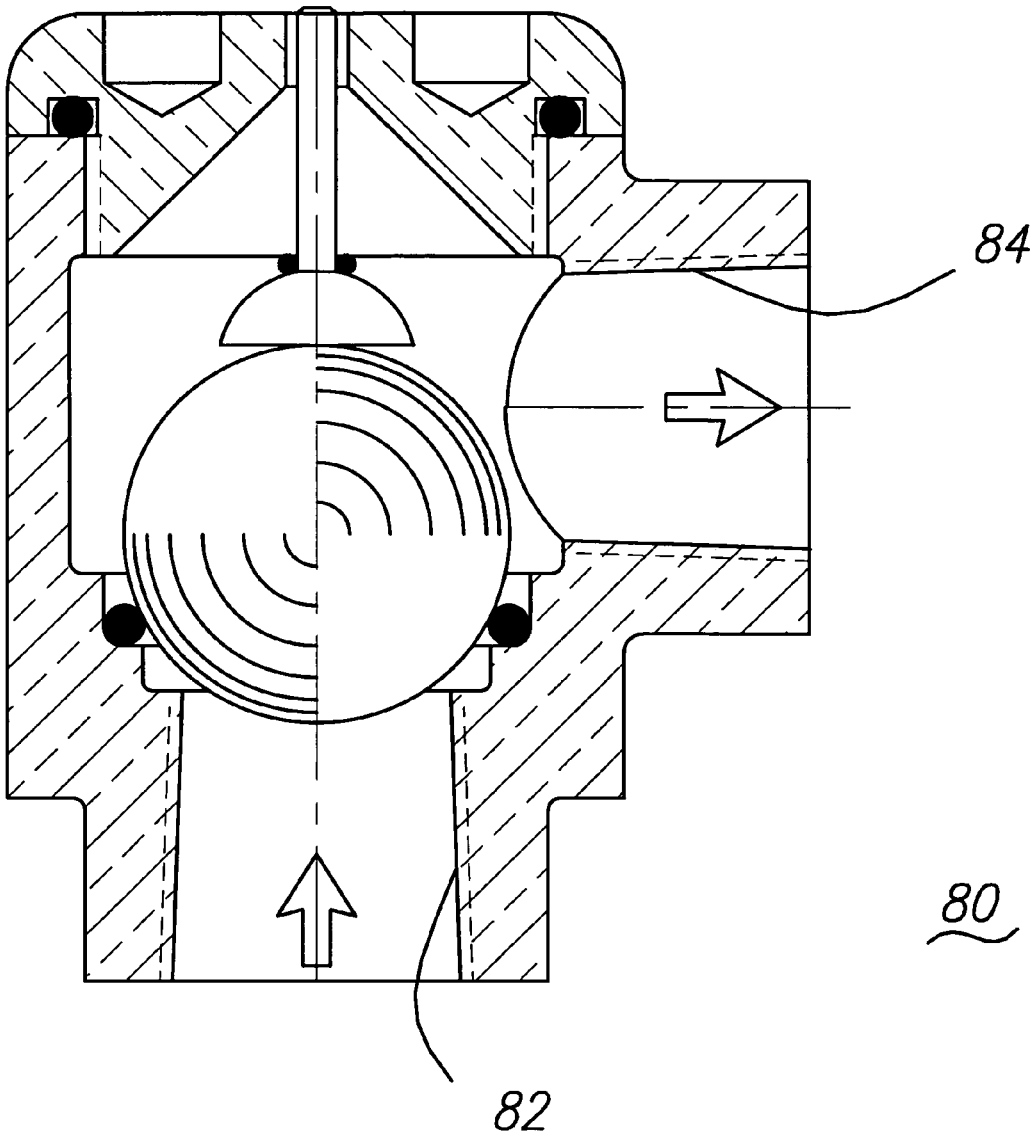
FIG. 6 is another configuration of the inlet and outlet of the valve.

As shown in FIG. 6, the valve 80 can be arranged with a lower vertical inlet 82 and a horizontal side outlet 84.

Figure 7:
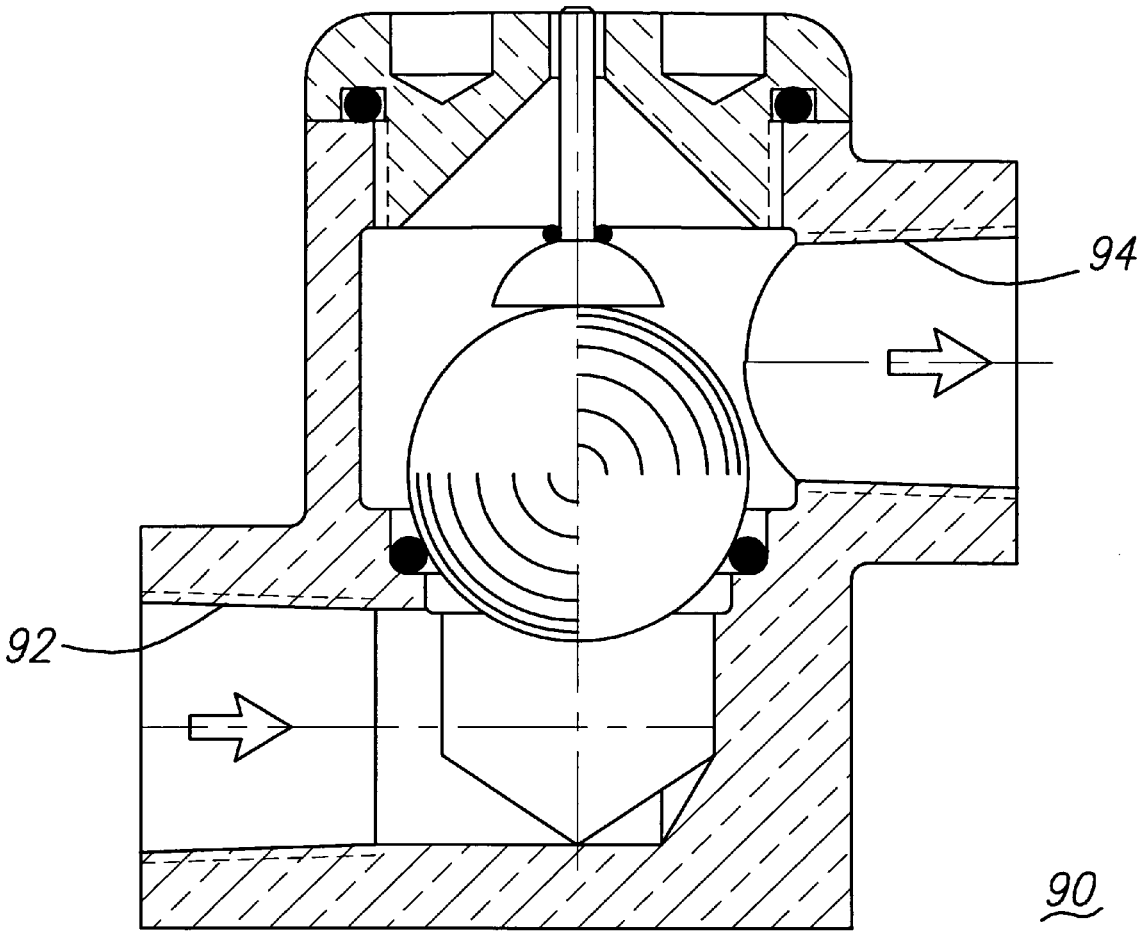
FIG. 7 is another configuration of the inlet and outlet of the valve.

As shown in FIG. 7, the valve 90 can also be arranged with a horizontal side inlet 92 and a horizontal side outlet 92. The valve can also be arranged with a horizontal side inlet and a lower vertical outlet. The valve can further be produced having the inlet and outlet configured 90° relative to each other.

The valve thus has an inlet fluid seal (ball and valve seat) and a separate and independent vent seal (vent plug and vent seat) to greatly improve the function and applications of the valve. The valve is very simple and economical to produce. The valve is very compact, reliable, durable, and can be located anywhere along the flow path, and does not require elevation above the discharge end. The valve only requires that the valve seat and vent seat be installed in a vertical orientation.

While specific embodiments and examples of the present invention have been illustrated and described herein, it is realized that modifications and changes will occur to those skilled in the art. It is therefore to be understood that the appended claims are intended to cover all such modifications and changes as fall within the spirit and scope of the invention.

The invention claimed is:

1. An anti-back flow vacuum breaker valve, comprising:

a valve body having a generally cylindrical internal chamber having a threaded upper end and having a reduced diameter lower portion forming a horizontal valve seat, and having an inlet communicating with the chamber on the underside of the valve seat, and having an outlet communicating with the chamber on the over side of the valve seat;

a spherical ball positioned within the chamber of said body having a diameter larger than the diameter of the valve seat for sealing the inlet of the valve;

a cylindrical valve cap having an upper portion mating with the upper end of said valve body and having a reduced diameter lower portion with external threads for engaging the threaded upper end of the chamber of said valve body and securely attached to said valve body, and having an internal conical chamber having a central vertical journal therein, forming a journal vent with a vent seat at the lower end thereof aligned with the valve seat of the valve body; and a buoyant vent plug having an upper stem slidably engaged within the journal vent of said cap, and the vent plug engagable with the vent seat; with the vent plug for elevation by said ball for sealing the vent, and for elevation by backflow of fluid through the outlet for sealing the vent.

2. The valve as define in claim 1, wherein the inlet is vertical and at the lower end of said valve body, and the outlet is vertical and at the lower end of said valve body.

3. The valve as define in claim 1, wherein the inlet is vertical and at the lower end of said valve body, and the outlet is horizontal and at the side of said valve body.

4. The valve as define in claim 1, wherein the inlet is horizontal and at the side of said valve body, and the outlet is horizontal and at the side of said valve body.

5. The valve as define in claim 1, wherein the inlet is horizontal and at the side of said valve body, and the outlet is vertical and at the lower end of said valve body.

6. The valve as define in claim 1, wherein the valve seat of said body further includes an elastomeric ring for sealing with said ball.

7. The valve as define in claim 1, wherein said vent plug has a semi-spherical upper surface and further includes an elastomeric ring around the stem for sealing with the vent seat.

8. The valve as define in claim 1, wherein the upper portion of said cap further includes an elastomeric ring for sealing with the upper end of said body.

9. The valve as define in claim 1, wherein the vent plug is formed of a poly material having a specific gravity less than that of the fluid, and said ball has a specific gravity greater than that of the fluid.

10. An anti-back flow vacuum breaker valve, comprising:

a valve body having a generally cylindrical internal chamber having an upper portion and a reduced diameter lower portion forming a horizontal valve seat, and having an inlet communicating with the chamber on the underside of the valve seat, and having an outlet communicating with the chamber on the over side of the valve seat;

a spherical ball positioned within the internal chamber having a diameter larger than the diameter of the valve seat for sealing the inlet of said valve body;

a valve cap having a lower portion mating with the upper portion of said valve body sealed and securely attached to said valve body, and having an internal conical chamber having a central vertical journal therein, forming a journal vent with a vent seat at the lower end thereof aligned with the valve seat of the body, and a buoyant vent plug having an upper stem slidably engaged within the journal vent of said cap, and said vent plug engagable with the vent seat, wherein said vent plug for elevation by said ball upon fluid flow through the inlet to seal the vent, and wherein said vent plug for elevation by backflow of fluid through the outlet to seal the vent.

* * * * *